US005526893A

United States Patent [19]

Higer

[11] Patent Number: 5,526,893

[45] Date of Patent: Jun. 18, 1996

[54] PHYSICAL THERAPY APPARATUS

[75] Inventor: Gary Higer, North Hollywood, Calif.

[73] Assignee: H. Eugene Mack, North Hollywood, Calif.

[21] Appl. No.: 187,207

[22] Filed: Jan. 27, 1994

[51] Int. Cl.[6] ..... A61H 3/04

[52] U.S. Cl. ..... 180/65.1; 280/43; 297/273; 482/68; 482/69

[58] Field of Search ..... 280/87.021, 87.05, 280/87.051, 30, 250.1, 304.1, 200, 657, 43, 47.34, 79.2, 47.41; 297/5, 6, 13, 44, DIG. 10, DIG. 4, 273, 274; 135/67; 482/66–69; 180/65.1, 65.2, 907

[56] References Cited

U.S. PATENT DOCUMENTS

| | | | |
|---|---|---|---|
| 2,327,671 | 8/1943 | Rupprecht | 280/87.021 |
| 2,625,202 | 1/1953 | Richardson et al. | 482/68 |
| 3,252,704 | 5/1966 | Wilson | 482/69 |
| 3,778,052 | 12/1973 | Andow et al. | 297/5 |
| 3,794,132 | 2/1974 | Moon | 180/65.1 |
| 3,872,945 | 3/1975 | Hickman et al. | 180/907 |
| 4,165,127 | 8/1979 | Vago | 297/345 |
| 4,342,465 | 8/1982 | Stillings | 280/87.051 |
| 4,375,840 | 3/1983 | Campbell | 180/6.5 |
| 4,456,086 | 6/1984 | Wier et al. | 180/11 |
| 4,621,804 | 11/1986 | Mueller | 272/70.3 |
| 4,768,536 | 9/1988 | Hawkins | 180/907 |
| 4,948,156 | 8/1990 | Fortner | 280/304.1 |
| 5,020,560 | 6/1991 | Turbeville | 135/67 |
| 5,152,730 | 10/1992 | Hoffman | 482/69 |
| 5,224,731 | 7/1993 | Johnson | 280/648 |
| 5,228,708 | 7/1993 | Verdugo | 280/200 |
| 5,273,502 | 12/1993 | Kelsey et al. | 482/69 |

*Primary Examiner*—Anne Marie Boehler
*Attorney, Agent, or Firm*—Thomas I. Rozsa; Tony D. Chen

[57] ABSTRACT

The present invention is a physical therapy apparatus for someone who either is a paraplegic and cannot walk or has had hip surgery and therefore cannot put full weight on one or both his or her legs. The novelty is that by having an adjustable sling assembly, the amount of weight the person can put on one or both of his or her legs can be varied so that as the physical therapy apparatus is used which can be used in a manual stage of walking or in a motorized stage with varying speeds, the person can put varying amounts of weight on either leg and can adjust the amount of weight relative to either leg based upon the alternating jackscrew movements driven by a DC motor to raise or lower the sling assembly from various heights to the ground.

29 Claims, 4 Drawing Sheets

FIG. 1
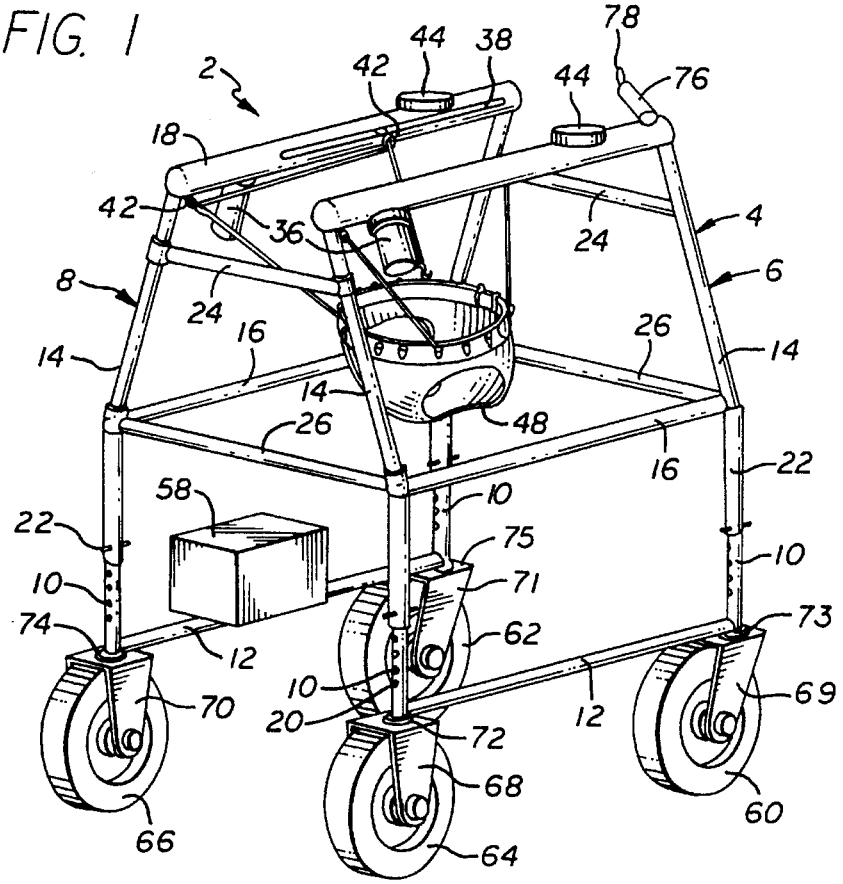
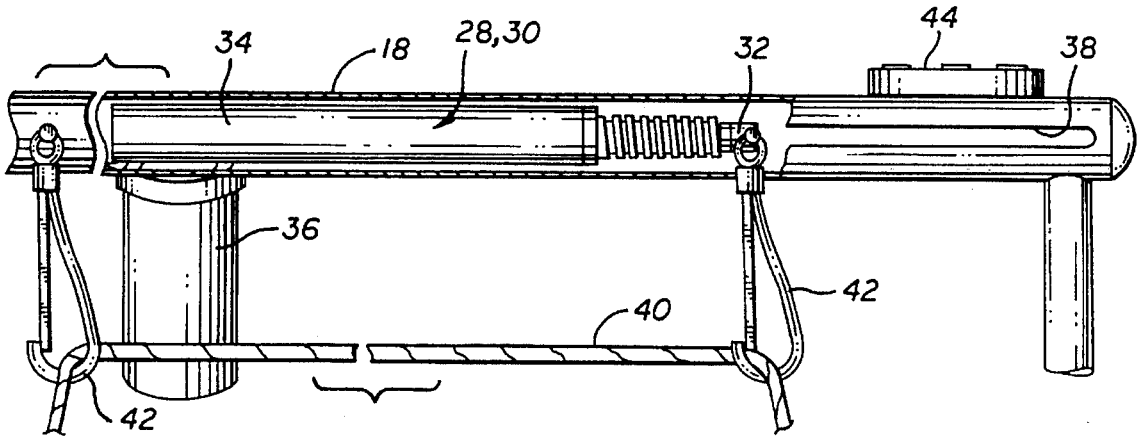
FIG. 3

FIG. 2
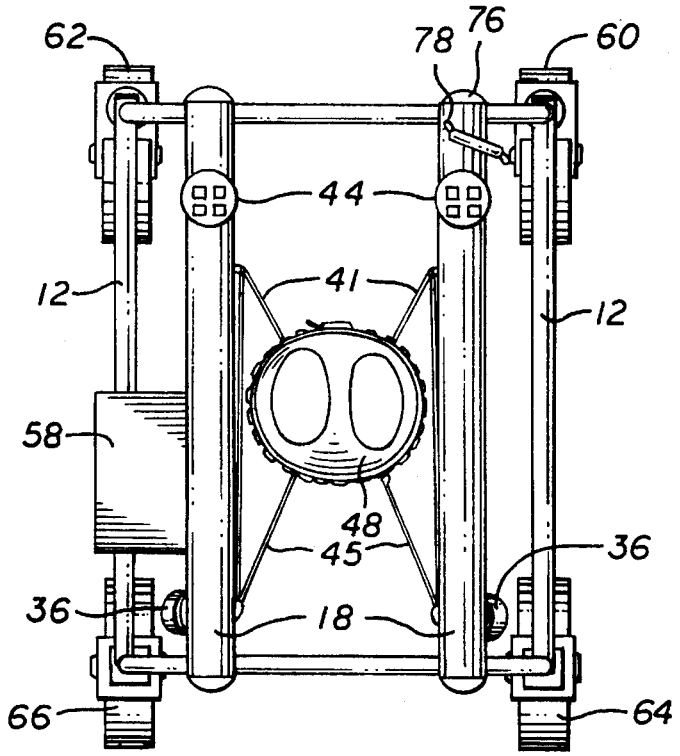
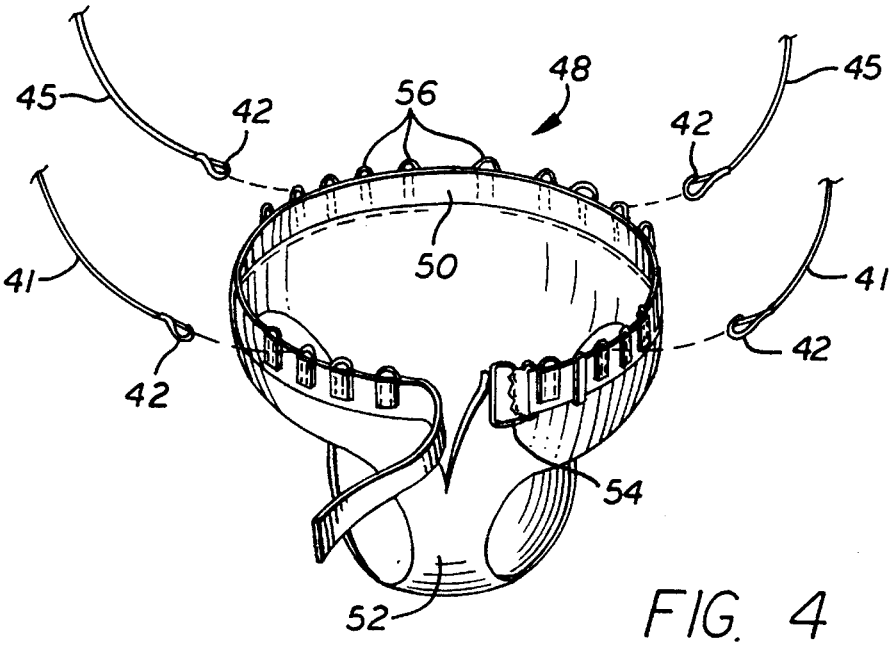
FIG. 4

FIG. 5
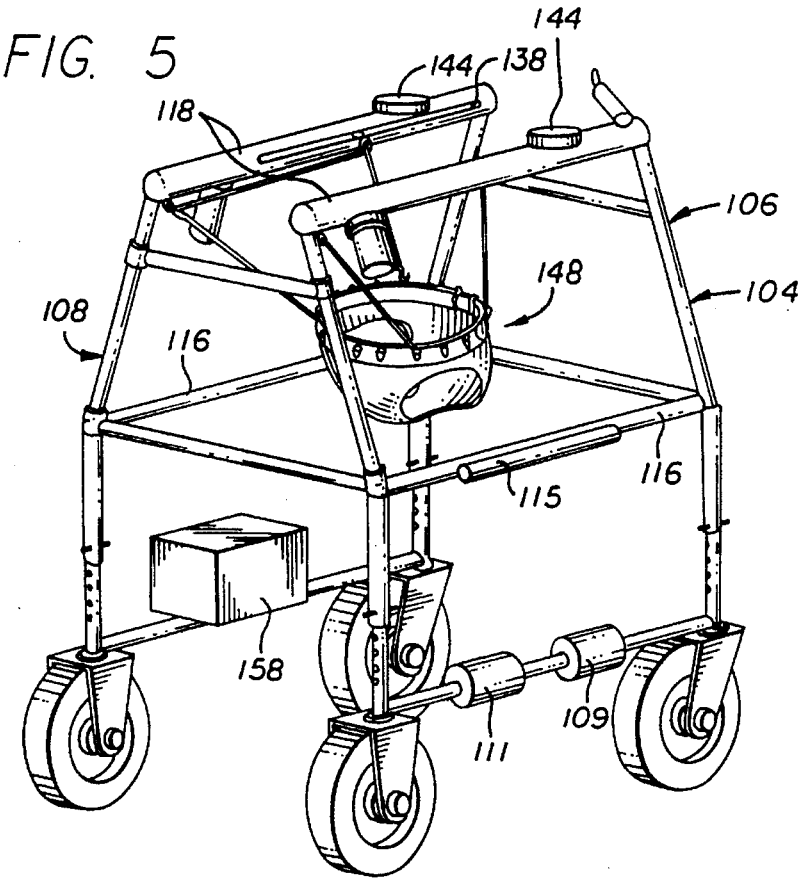
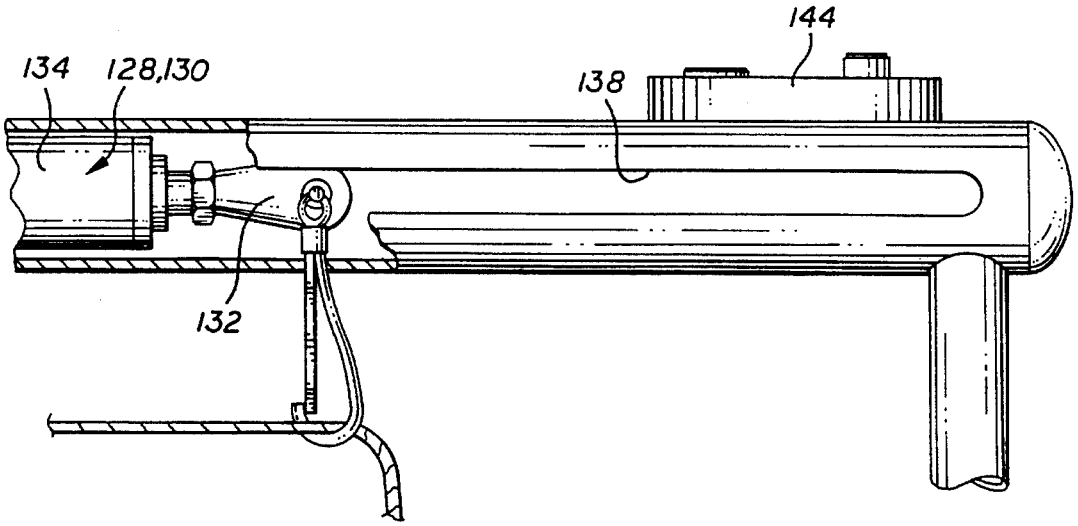
FIG. 6

FIG. 7
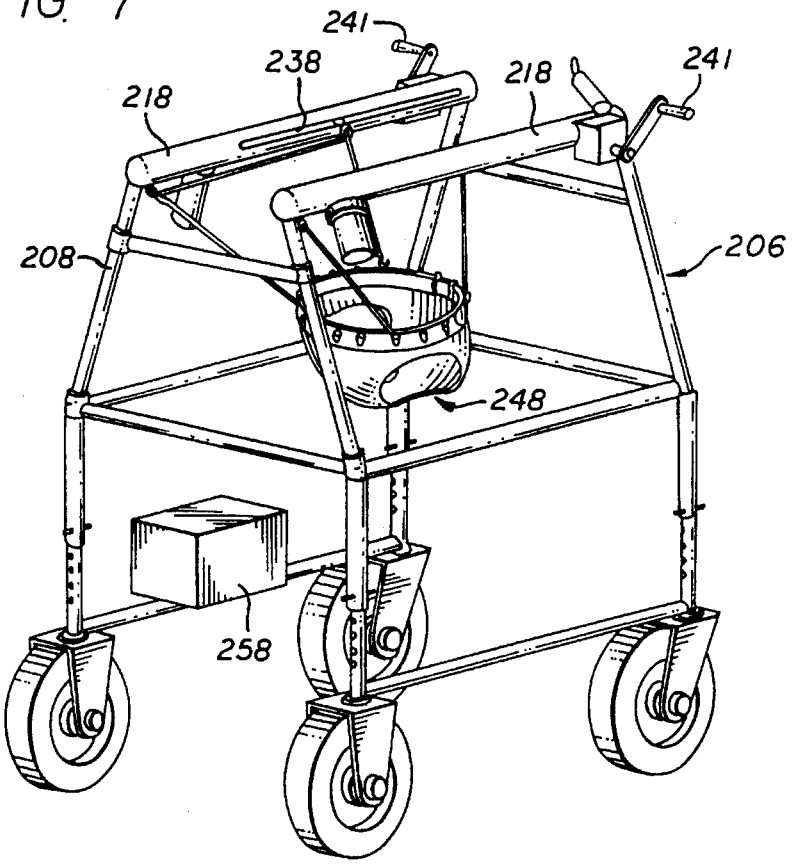
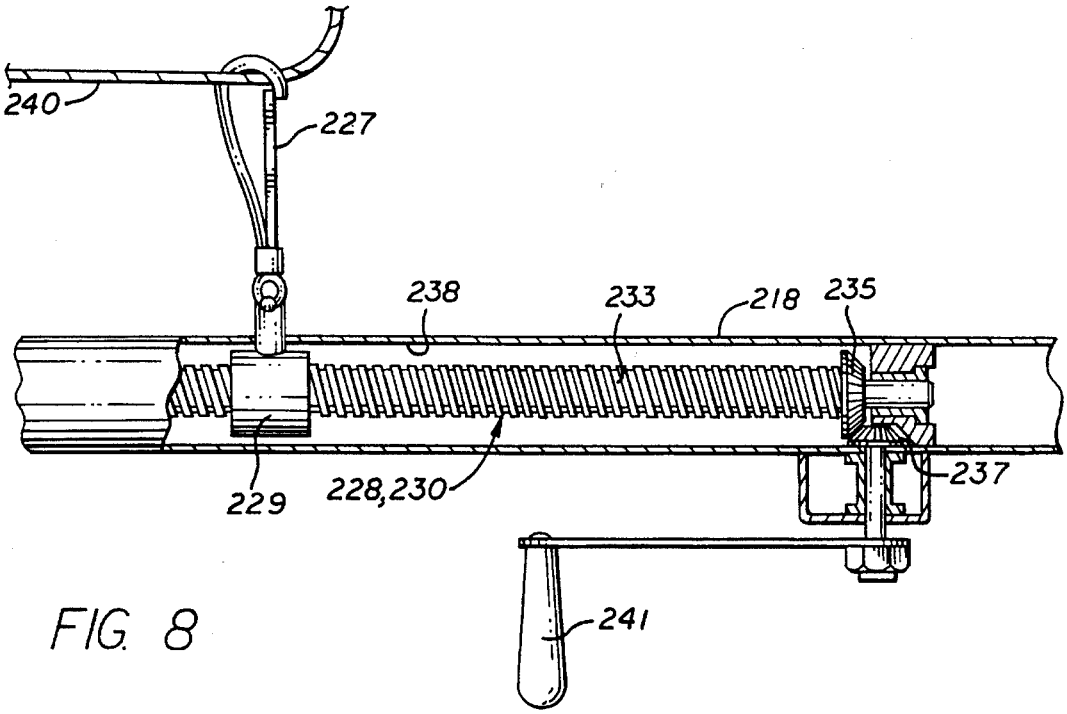
FIG. 8

PHYSICAL THERAPY APPARATUS

BACKGROUND OF THE INVENTION

1. Field of the Invention

The present invention relates to the field of therapeutic walkers. More particularly, the present invention relates to the field of controlled powered wheeled walkers for individuals with leg problems as well as an assist, on a permanent basis, for certain currently non-ambulatory patients.

2. Description of the Prior Art

In general, therapeutic walkers and wheelchairs are old in the art and have been employed for many years for assisting physically handicapped individuals and convalescent patients who are undergoing rehabilitation. In the prior art, there are various types of therapeutic or rehabilitative equipment for preventing the development of deformities caused by muscular deficiency and to aid the physical development of the patients. In particular, the support and locomotion areas are generally insufficient to satisfy the therapeutic requirements with respect to the support of the patient and to prevent the development of abnormalities.

One of the many disadvantages in the prior art is that they are highly mechanical which are very expensive to manufacture. Another disadvantage is that the amount of weight which the individual is supposed to put on the legs cannot be properly adjusted by conventional walkers.

The following ten (10) prior art patents were uncovered in the pertinent field of the present invention.

1. U.S. Pat. No. 2,327,671 issued to Rupprecht on Aug. 24, 1943; for "Walker Mechanism For Invalids" (hereafter "the Rupprecht Patent").

2. U.S. Pat. No. 3,778,052 issued to Andow et al. on Dec. 11, 1973 for "Walker With Adjustable Crutch" (hereafter "the Andow Patent").

3. U.S. Pat. No. 3,872,945 issued to Hickman et al. on Mar. 25, 1975 for "Motorized Walker" (hereafter "the Hickman Patent").

4. U.S. Pat. No. 4,165,127 issued to Vago on Aug. 21, 1979 for "Therapeutic And Rehabilitative Carriage" (hereafter "the Vago Patent").

5. U.S. Pat. No. 4,375,840 issued to Campbell on Mar. 8, 1983 for "Mobile Support" (hereafter "the Campbell Patent").

6. U.S. Pat. No. 4,456,086 issued to Wier et al. on Jun. 26, 1984 for "Integrated Wheelchair And Ambulator" (hereafter "the Wier Patent").

7. U.S. Pat. No. 4,621,804 issued to Mueller on Nov. 11, 1986 for "Therapeutic Roller/Walker" (hereafter "the Mueller Patent").

8. U.S. Pat. No. 5,152,730 issued to Hoffman on Oct. 6, 1992 for "Handless Walking Aid For Preventing Falls From Loss Of Balance" (hereafter "the Hoffman Patent").

9. U.S. Pat. No. 5,224,731 issued to Johnson on Jul. 6, 1993 for "Combination Wheel Chair And Walker" (hereafter "the Johnson Patent").

10. U.S. Pat. No. 5,228,708 issued to Verdugo on Jul. 20, 1993 for "Walker And Exercise Apparatus For Functional Recovery" (hereafter "the Verdugo Patent").

The Rupprecht Patent discloses a walker mechanism for invalids. It includes a gauge scale used for determining the weight of the patient and determining the weight pressure allowable on the legs as prescribed by the circumstances of the invalid's condition. Two body supporting cables are secured to a ring while the ring is engaged over a hook. The suspender springs are attached to the ends of the cables and support the body suspension assembly to suspend the trunk.

The Andow Patent discloses a walker with adjustable crutch head supports. It includes an adjustable height crotch sling and a belt assembly for application to a handicapped person or convalescent patient. The sling is supported by four corner spring closed hooks which are engageable with the lower anchor rings.

The Hickman Patent discloses a motorized walker for use by disabled persons in a standing position within the walker.

The Vago Patent discloses a therapeutic and rehabilitative carriage. The vehicle has a frame which supports independently adjustable elements. includes a seat, back support, an activity table, foot support, and associated limb positioning and restraining elements. Also disclosed is a unique locking apparatus for adjusting the position and attachment of the various elements.

The Campbell Patent discloses a mobile support which utilizes a hydraulic pump and hydraulic cylinders. The mobile support includes a frame having a first pair of elevated diametrically opposite corner portions and a second pair of low elevation corner portions. The mobile support is moved in a horizontal plane by the operator of the support and adjustment of the operator seat of the support may be effected both vertically and horizontally relative to the support.

The Wier Patent discloses a combination of a motor-driven frame and a separable mating ambulator. The ambulator is provided with a linkage mechanism for raising and lowering the paraplegic from and to the frame. With the paraplegic supported by the linkage in a standing position on the ambulator platform, the ambulator can be detached from the frame and easily maneuvered by the paraplegic in and around the confined spaces.

The Mueller Patent discloses a therapeutic roller/walker. It includes upper and lower horizontal tubular frame members which extend across the front and toward the rear along both sides of the roller/walker. An elongated crotch-cradling panel is removably attached between the closure bar and the frame on the opposite side of the walker. The person using the walker straddles the crotch-cradling panel which also can be adjustable in length for persons of different sizes. The legs of the walker are adjustable in height and terminated in removable or retractable casters.

The Hoffman Patent discloses a handless walking aid for preventing falls from loss of balance.

The Johnson Patent discloses a combination wheel chair and walker. The walker is assembled by the front cross piece segments which are folded toward each other causing the uprights to come together at the front of the device and placing the two front wheels together so they are operable as a single dual wheel.

The Verdugo Patent discloses a walker and exercise apparatus for functional recovery.

All of these prior art patents are characterized by an increased need for improved postural support in order to aid individuals with leg problems and disabled individuals as well as an assist, on a permanent basis, for certain currently non-ambulatory patients. Although the prior art wheelchairs and walkers have become highly sophisticated, they do not provide the physical and psychological benefits for someone who either is a paraplegic and cannot walk or has had hip surgery and therefore cannot put full weight on one or both of his or her legs. No such prior art device provides a device wherein a person can position himself or herself in a substantially standing position with the amount of weight which the individual can put on each leg individually being properly adjusted.

Therefore, it is highly desirable to have a very efficient and also very effective design and construction of a physical therapy apparatus which can eliminate the improper posture development of an individual so that the individual can regain strength in the legs in a much more efficient way.

SUMMARY OF THE INVENTION

The present invention is a physical therapy apparatus for someone who either is a paraplegic and cannot walk or has had hip surgery and therefore cannot put full weight on one or both of his or her legs. The novelty is that by having an adjustable sling assembly, the amount of weight the person can put on one or both of his or her legs can be varied as the physical therapy apparatus is used. The device can be used in a manual stage of walking or in a motorized stage with varying speeds. The person can put varying amounts of weight on either leg and can adjust the amount of weight relative to either leg based upon the alternating jackscrew movements driven by a DC or hydraulic motor to raise or lower the sling assembly from various heights to the ground. The location of where the person is supported can also be varied.

The present invention physical therapy apparatus can also be used for people who are wheelchair bound. It will give such a person the ability to stand vertically and not have pressure on his or her legs because the sling assembly can be raised to a height so that the bottom of his or her feet is completely off the ground while they are still standing relatively vertical.

In addition, there are loops around the belt or diaper through which the person fits his or her legs and there are connecting rings at the top portion of the sling assembly. A cable or string on each side of the apparatus is attached to a respective front and rear connecting ring which then is attached around the jackscrew and pulled taut to raise or lower that side of the diaper. Another unique feature of the present invention is the ability to put the cable at a location which will be comfortable to the wearer. For example, if the person has had surgery on the outside of the hip, the loop used can be closer to the middle portion of the person's body to have the pressure points away from the outside. Similarly, if the person has had a more interior type surgery on the legs, the cable can be drawn through two pairs of outside loops so that the pressure from raising or lowering the diaper can be placed on the outside away from the surgery. In addition, the present invention provides the ability to adjust and locate the point where the pressure will be applied underneath the person by having adjustable loops at different locations either closer to the person's outside or inside.

It has been discovered, according to the present invention, that by utilizing a physical therapy apparatus with an adjustable sling assembly, the amount of weight the person can put on one or both of his or her legs can be varied so that as the physical therapy apparatus is used, the person can put varying amounts of weight on either leg and can adjust the amount of weight relative to either leg from various heights above the ground.

It has also been discovered, according to the present invention, that the adjustable sling assembly can be adjusted by alternating jackscrew movements driven by a DC or hydraulic motor. It will therefore provide the adjustable sling with a means to be raised or lowered from various heights so that the person can regain strength in the legs in a much more efficient manner.

It has additionally been discovered, according to the present invention, that the adjustable sling assembly can be raised and lowered by alternating hydraulic piston movements driven by hydraulic pressure. It will therefore provide an alternative means to raise or lower the adjustable sling assembly from various heights so that the person can regain strength in his or her legs in a much more efficient way.

It has further been discovered, according to the present invention, that the adjustable sling assembly can be raised and lowered by alternating bevel gear mechanisms which are manually driven by a crank. It will therefore provide an alternative means to raise or lower the adjustable sling assembly from various heights so that the person can regain strength in his or her legs in a much more efficient way.

It is therefore an object of the present invention to provide a physical therapy apparatus which can be utilized not only by individuals requiring minimal support to walk but also individuals requiring greater amounts of support including almost total support.

It is also an object of the present invention to provide a physical therapy apparatus so that it is capable of being used safely by a person subject to falling.

It is another object of the present invention to provide a physical therapy apparatus of stable configuration and which includes an adjustable sling assembly which can be adjusted in different ways as the strength of a convalescing patient improves.

It is an additional object of the present invention to provide a physical therapy apparatus which can be readily adjusted in order to conform to the height of a particular individual using the device.

It is a further object of the present invention to provide a physical therapy apparatus with an adjustable sling assembly which can be adjusted by utilizing alternating jackscrew movements driven by a DC motor, alternating hydraulic piston movements driven by hydraulic pressure or an alternating meshed bevel mechanism manually driven by a crank so that the adjustable sling assembly can be raised or lowered from various heights.

It is an even further object of the present invention to provide a physical therapy apparatus in accordance with the preceding objects which will conform to conventional forms of manufacture, be of simple construction and easy to use so as to provide a device that will be economically feasible, long lasting and relatively trouble-free in operation.

In the preferred embodiment of the present invention, the physical therapy apparatus utilizes alternating jackscrew movements driven by a DC motor to raise or lower the sling assembly. In addition, the present invention includes the ability to adjust the location at which the person will be elevated.

In an alternative embodiment of the present invention, the physical therapy apparatus utilizes alternating hydraulic piston movements driven by hydraulic pressure to raise or lower the sling assembly.

In another alternative embodiment of the present invention, the physical therapy apparatus utilizes an alternating bevel gear mechanism which is manually driven by a crank to raise or lower the sling assembly.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a perspective view of the preferred embodiment of the present invention physical therapy apparatus.

FIG. 2 is a top plan view of the preferred embodiment of the present invention physical therapy apparatus.

FIG. 3 is an enlarged partial cut-out side view of the preferred embodiment of the present invention physical therapy apparatus showing one of the two jackscrew mechanisms driven by a DC motor.

FIG. 4 is a perspective view of the sling assembly and the hook means.

FIG. 5 is a perspective view of an alternative embodiment of the present invention physical therapy apparatus.

FIG. 6 is an enlarged partial cut-out side view of the alternative embodiment of the present invention physical therapy apparatus showing one of the two hydraulic piston fluid cylinders driven by hydraulic pressure.

FIG. 7 is a perspective view of another alternative embodiment of the present invention physical therapy apparatus.

FIG. 8 is an enlarged partial cut-out top plan view of the alternative embodiment of the present invention physical therapy apparatus showing one of the two meshed bevel gear mechanisms manually driven by a crank.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Described briefly, the present invention is a physical therapy apparatus for people with leg problems as well as an assist, on a permanent basis, for certain currently non-ambulatory patients. It provides vertical stability for the user as well as battery powered assistance in movement when required. A preferred embodiment of the physical therapy apparatus includes a frame structure supported by a pair of independent-mounted front and rear wheels, two jackscrew mechanisms driven by two DC motors for raising or lowering of a sling assembly, a drive motor and an electric storage battery.

FIG. 1 shows a perspective view of the preferred embodiment of the present invention physical therapy apparatus 2. Referring to FIGS. 1 and 2, the physical therapy apparatus 2 is a motorized walker which is utilized for people with leg problems as well as an assist, on a permanent basis, for certain currently non-ambulatory patients. The physical therapy apparatus 2 is a generally rectangular shaped frame structure 4 which includes a pair of juxtaposed, interconnected side frame sections 6 and 8. Each of the four corners of the frame structure 4 is provided with vertical legs, having lower portions 10 attached to a lower side rail 12 and upper portions 14 which telescope onto the lower portions 10. The upper portions 14 are interconnected to a middle side rail 16 and an upper side rail 18.

Each of the lower leg portions 10 has a multiplicity of equally spaced apart holes 20 located therein and facing toward each other for vertical adjustment of the side frame sections 6 and 8 with respect to the ground. The vertical adjustment is effected by means of metal pins 22 inserted into the desired hole position on each lower leg portion 10.

The upper side rails or handrails 18 of each side frame section 6, 8 can serve as an arm rest and can be grasped by a user when entering or adjusting his position within the physical therapy apparatus 2. Each of the upper handrails 18 has an elongated narrow side groove 38 which faces each other and contains an electrically operated jackscrew mechanism. The upper portion of the frame structure 4 is tapered inwardly such that a user can be comfortable within the physical therapy apparatus 2.

The front and rear of the physical therapy apparatus 2 are formed by a pair of horizontally spaced apart bars 24 and 26. These horizontal bars 24 and 26 and other members of the frame structure 4 function as rigidifying and strengthening means, and also function as support means for other components of the physical therapy apparatus 2. The pair of horizontal bars 24 and 26 at the rear of the frame structure 4 are removable to allow for easy access to the physical therapy apparatus 2 and are snapped-on at the rear of the frame structure 4 to selectively close the area occupied by the person using the physical therapy apparatus 2.

The present invention physical therapy apparatus 2 is preferably constructed of steel tubing or any suitable means. The outside dimensions of the rectangular lower portion of the frame structure 4, which is the largest part, is approximately twenty-six (26) inches wide by thirty (30) inches long. The dimension is limited to easily fit through a normal doorway. The upper portion of the frame structure 4 is slightly smaller than the lower portion, for example approximately four (4) inches. The upper portion is parallel to the lower portion, and is made slightly smaller for added stability.

It will be appreciated that the dimensions described above are merely one illustrative embodiment and can include many other comparable sets of dimensions.

Referring to FIG. 3, there is shown an enlarged partial cut-out side view of one of the two jackscrew mechanisms 28, 30 utilized in the present invention. Because the jackscrew mechanisms 28 and 30 are substantially identical in construction, only one will be described in detail. The jackscrew mechanism 28 is driven by a DC motor 36 which is mounted underneath the upper side rail 18 adjacent to the rear of the frame structure 4. The jackscrew 28 has a lower end 34 and an upper end 32 which can be extended or retracted in a horizontal axis. The lower end 34 of the jackscrew 28 is affixed to the rear of the upper side rail 18 such that the upper end 32 can be extended forwardly or backwardly. There are provided two locking hook means 42 which are affixed at the rear of each upper side rail 18 and the upper end 32 of each of the jackscrews 28 and 30 respectively. The locking hook means 42 at the upper ends 32 of the jackscrews 28 and 30 are extending outwardly beyond the narrow side grooves 38. This allows the locking hook means 42 to be moved in the horizontal direction.

Each of the jackscrew mechanisms 28 and 30 is provided with a control means 44 for controlling the raising and lowering of a sling assembly 48, as shown in FIG. 4. Each respective jackscrew mechanism 28 and 30 is conveniently located within the upper side of both the left hand and right hand handrails 18.

Referring to FIGS. 1, 2, 3 and 4, there are two cables or straps 40, one on each of the side frame sections 6 and 8. Each cable 40 has a first end 41 and a second end 45 with locking hook means 42 for attachment to the sling assembly 48. Each cable 40 forms a closed circle which is hooked to the locking hook means 42 at rear of the upper side rail 18 and the upper end 32 of the jackscrew 28 such that the first and second ends 41, 45 of the cable 40 are extending downwardly toward the sling assembly 48.

Referring to FIG. 4, there is shown a perspective view of the sling assembly 48 which is adapted to pass entirely between the legs of the person using the physical therapy apparatus 2. The sling assembly 48 includes an elongated adjustable belt 50 for encircling the waist of the person and a generally hourglass shaped diaper 52. One end of the belt 50 is provided with a buckle assembly 54 with which the other free end of the belt 50 can be operatively engaged in order to adjust the effective circumference of the belt 50. The belt 50 includes a multiplicity of peripherally spaced apart connecting rings 56 which are located at the top of the belt 50. These connecting rings 56 are utilized for allowing the locking hook means 42 to be hooked to the sling assembly 48. The hourglass shaped diaper 52 can be two wide cloth straps, fitting on the inside of the thighs. The diaper 52 is attached to the bottom of the belt 50. The person is supported by the sling assembly 48 which will be adapted to fit the medical condition of the patient.

The two cables 40, one on each side of the body, are connected to one of the multiplicity of connecting rings 56 at the front and rear of the belt 50. The position of the attachment is adjustable to provide the optimum support with the least stress to the user by connecting the locking hook means 42 to the proper connecting rings 56 of the sling assembly 48. As the jackscrew 28 is extended, the separating of the respective locking hook means 42 will raise that side of the body to the desired height.

If the patient had a medical problem which would not allow for this type of sling assembly, a girdle type device belt would be fastened around the waist area or above, with the same connecting points and cables as the sling for connection to the device.

Referring again to FIGS. 1 and 2, the storage battery 58 is preferably one which will hold a substantial charge and which can be repeatedly charged. By way of example, an automobile lead-acid storage battery or any suitable battery can be used. The storage battery 58 is mounted adjacent to the lower portion of the frame structure 4 and powers a drive motor (not shown) to drive the physical therapy apparatus 2 and the DC motors 36 which drive the jackscrew mechanisms 28 and 30.

There are a pair of large independently-mounted front and rear wheels 60, 62, 64 and 66 attached to the frame structure 4 to allow for easy rolling. These wheels support the frame structure for transportational movement over a surface. The front wheels 60, 62 are each rotatably carried on forks 69 and 71, respectively. The forks 69, 71 are mounted for swivel movement in vertical sleeves 73, 75, which are joined to the frame structure 4 at the front of the lower side rails 12. One of the front wheels 60 is powered and serves as the drive wheel and the steering, while other front wheel 62 is free-wheeling. The rear wheels 64, 66 are also each rotatably carried on forks 68 and 70, respectively. The forks 68, 70 are mounted in vertical sleeves 72, 74, which are joined to the frame structure 4 at the rear of the lower side rails 12 to prevent directional turning of the rear wheels 64 and 66. The rear wheels 64 and 66 are fixed for forward-reverse movement only.

The physical therapy apparatus 2 provides for movement on level floors and ramps. It will easily navigate through normal doorways. It allows the user freedom of hand movements while remaining in an upright position, without fear of falling.

Steering means 76 is connected at its lower end to one of the front wheels 60 and rotatably connected at its upper end to one of the two handrails 18 for hand operation by a person using the physical therapy apparatus 2. Steering means 76 is provided for changing the direction in order to control the directional movement of the physical therapy apparatus 2. The steering means 76 and the power control switch means 78 are similar to those currently used in motorized wheelchairs to allow for accurate steerage and power adjustments, and the description thereof will not be described.

It will be appreciated that the one drive wheel in front to be used for both power and steering is not limited to the description above. It is noted that the power and steering that propels the physical therapy apparatus 2 can be replaced with comparable power and steering mechanisms. In addition, it will not be too hard for one skilled in the art to change the power and steering of the physical therapy apparatus 2.

All of the electrical wirings are concealed within the steel tubing of the frame structure 4. This not only is aesthetically pleasing but eliminates the risk of the user becoming tangled in any of the electrical wirings.

The operation of the foregoing embodiment now will be described. To properly utilize the physical therapy apparatus 2, the sling assembly 48 is first worn. The locking hook means 42 at the ends 41, 45 of the cables 40 are connected to the appropriate connecting rings 56 on the belt 50 on both sides of the user's body. The cables 40 are sufficient in length to be hooked to the locking hook means 42 at the rear of the upper side rails 18 and the upper ends 32 of the jackscrews 28 and 30. When the person is properly connected to the physical therapy apparatus 2, the amount of weight by which the person is supported by each leg independently can be properly adjusted. The amount of weight which is allowed on each leg can be individually adjusted from zero to full body weight. If the person is able to put enough weight on his or her legs to propel the physical therapy apparatus 2 without assistance from the motor, the motorized wheel can be disengaged to use the physical therapy apparatus 2 as a walker. The patient would still have the full support of the apparatus 2 to keep him or her erect and prevent falling. If the person is only able to put minimal pressure on his or her legs, the proper adjustment can be made by adjusting the locking hook means 42 to the appropriate connecting rings 56 and the amount of extension on the jackscrew mechanisms 28, 30 and the motor would assist in movement to whatever extent the patient required.

In addition, the location of the pressure can be adjusted depending on which one of the connecting rings 56 is used. If the person has had surgery on the interior of his or her legs, it is desirable for the carrying pressure to be on the outer portion of the belt 50. Therefore, the cables 40 and respective locking hooks 42 are hooked onto outer connecting rings 56. Conversely, if it is desired to have the lifting pressure on the inner portion, the locking hook means 42 are attached to inner connecting rings 56. It is also within the spirit and scope of the present invention to have different amounts of pressure on each side so that one side of a person is supported higher than the other side.

Referring to FIG. 5, there is shown a perspective view of an alternative embodiment of the present invention physical therapy apparatus 102. This alternative embodiment is identical to the preferred embodiment as previously described above except that the hydraulically operated piston fluid cylinders 128, 130 are substituted for the jackscrew mechanisms 28 and 30 shown in FIG. 3. The parts are numbered correspondingly with 100 added to each number. Only the modified components of the physical therapy apparatus 102 will be described.

The upper side rails or handrails 118 of each side frame section 106, 108 can serve as an arm rest and can be grasped by a user when entering or adjusting his position within the physical therapy apparatus 102. Each of the upper handrails 118 has an elongated narrow side groove 138 which faces each other and contains the hydraulically operated piston fluid cylinder.

The storage battery 158 is preferably one which will hold a substantial charge and which can be repeatedly charged. By way of example, an automobile lead-acid storage battery or any suitable battery can be used. The storage battery 158 is mounted adjacent to the lower portion of the frame structure 104 and powers a drive motor (not shown) which drives the physical therapy apparatus 102 and another drive motor 109 which drives a hydraulic pump assembly 111.

FIG. 6 shows an enlarged partial cut-out side view of one of the two hydraulic piston fluid cylinders 128, 130 utilized in the alternative embodiment of the present invention. Because the hydraulic piston fluid cylinders 128 and 130 are substantially identical in construction, only one will be described in detail. The hydraulic piston fluid cylinder 128 includes a lower portion which is a fluid cylinder 134 and an upper portion which is a piston 132. The piston 132 can be extended or retracted in a horizontal axis by a control means 144. The fluid cylinder 134 is affixed to the rear of the upper side rail 118 such that the piston 132 can be extended or retracted in the horizontal direction.

Referring to FIGS. 5 and 6, each of the hydraulic piston fluid cylinders 128 and 130 is provided with the control means 144 for controlling the raising and lowering of the sling assembly 148, and is conveniently located within the upper side of both the left hand and right hand handrails 118. The drive motor 109 drives the hydraulic pump assembly 111 which supplies fluid under pressure to a valve assembly (not shown). Suitable hoses interconnect the valve assembly, a hydraulic pump 115 and two fluid cylinders 134 (one on each side) and as well as the motor 109 through the control means 144. Of course, any suitable form of hydraulic control assembly of a well known type may be used for this purpose.

The hydraulic piston fluid cylinders 128 and 130 can be manually operated by the hydraulic pump 115 which is mounted on the middle side rail 116 of the frame structure 104.

All of the hydraulic hoses and the electrical wirings are concealed within the steel tubing of the frame structure 104. This not only is aesthetically pleasing but eliminates the risk of the user becoming tangled in any of the electrical wirings. It is conceivable that the hydraulic hoses can be mounted outside of the steel tubing of the frame structure 104.

Referring to FIGS. 7 and 8, there is shown a perspective view of another alternative embodiment of the present invention physical therapy apparatus 202. This alternative embodiment is identical to the preferred embodiment as previously described in FIGS. 1 through 4 except that the two bevel gear mechanisms 228, 230 are substituted for the jackscrew mechanisms 28 and 30 shown in FIG. 3, the parts are numbered correspondingly with 200 added to each number. Only the modified components of the physical therapy apparatus 202 will be described.

FIG. 8 shows an enlarged partial cut-out top plan view of one the two bevel gear mechanisms 228, 230. Because the two bevel gear mechanisms 228 and 230 are substantially identical in construction, only one will be described in detail.

The upper side rails or handrails 218 of each side frame section 206, 208 can serve as an arm rest and can be grasped by a user when entering or adjusting his position within the physical therapy apparatus 202. Each of the handrail 218 has an elongated narrow side groove 238 which faces each other and contains the bevel gear mechanism 228. An internal elongated threaded driving rod 233 is affixed within the handrail 218. A screw collar 229 is threadedly engaged with the internal threaded driving rod 233 and has a locking fastener or hook 227 protruding outwardly from the narrow side groove 228. There is also another locking hook (not shown) affixed at the rear of the handrail 218. A cable 240 is hooked to both the locking hooks 227 such that both ends of the cable 240 are extending downwardly toward the sling assembly 248. At the ends of the cable 240 are provided with locking hook means for attaching to the sling assembly 248.

The two bevel gears 235 and 237 are secured within the upper side handrail 218 and located adjacent to the front of the frame structure 204. The first bevel gear 235 is attached to the elongated threaded driving rod 233 at one end and is in mesh with the second bevel gear 237 which is rotatable by a crank 241. When the crank 241 is rotated, which action revolves the second gear 237, which in turn will revolve the first gear 235 thereby turning the elongated threaded driving rod 233, this action allows the screw collar 229 to move forward or backward in a horizontal direction, thereby raising or lowering the sling assembly 248.

The present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A power walker for use by a person with leg problems, comprising:

a. a rectangular frame structure extending around a front end, a rear end and two opposite sides of an area occupied by said person using said power walker, the frame structure having a pair of vertical front telescoping legs and a pair of rear telescoping legs for adjusting a vertical height of the frame structure, each vertical telescoping leg having a multiplicity of equally spaced apart holes located therein;

b. means for retaining said vertical height adjustment of said frame structure;

c. a pair of independently-mounted front and rear wheels each respectively secured to said pairs of vertical front and rear telescoping legs at their lower ends for supporting said frame structure;

d. a sling assembly adapted to support said person using said power walker and having an adjustable belt with a multiplicity of connecting rings;

e. a pair of horizontal and opposite upper side rails functioning as handrails, the upper side rails secured to said pairs of vertical front and rear telescoping legs at their upper ends, each upper side rail having an elongated narrow slit groove, each groove facing the other, and a first locking hook mounted to each one of the upper side rails and located adjacent to said rear end of said frame structure;

f. a jackscrew mechanism respectively mounted within each one of said pair of opposite handrails and having a collar thereon with a second locking hook attached to the collar and a reversible drive motor for turning the jackscrew mechanism;

g. control means mounted on each one of said pair of horizontal and opposite upper side rails for controlling the extension of said collars of said jackscrew mechanisms;

h. at least two cables, each cable having a first end and a second end, where a respective one of the at least two cables is hooked through a respective set of said locking hooks at said respective collar and said respective upper side rail, and the first and second ends of the at least two cables having locking hooks for attaching to selective ones of said multiplicity of connecting rings of said adjustable belt respectively in order to locate the lifting pressure on said person;

i. said jackscrew mechanism is rotated to cause said collar to move in a horizontal direction to thereby raise or lower a selective location on said sling assembly for the purpose of adjusting the amount of weight on each leg of said person;

j. steering means for steering said power walker;

k. means for driving each one of said front wheels;

l. power control switch means for powering and steering said power walker; and m. at least one electric storage battery electrically connected to said means for driving each one of said front wheels of said power walker;

n. whereby when said person is properly connected to said power walker, the amount of weight by which said person is supported by each leg independently can be properly adjusted by connecting said locking hooks at said first and second ends of said at least two cables to said connecting rings and extending or retracting said collars of said jackscrew mechanisms respectively.

2. The power walker as defined in claim 1 wherein said frame structure is made out of metal tubing.

3. The power walker as defined in claim 1 wherein said means for retaining said vertical height adjustment of said frame structure includes four metal pins each inserted into a selective one of said multiplicity of holes on said pairs of vertical front and rear telescoping legs respectively.

4. A power walker for use by a person with leg problems, comprising:

a. a rectangular frame structure extending around a front end, a rear end and two opposite sides of an area occupied by said person using said power walker, the frame structure having a pair of vertical front telescoping legs and a pair of rear telescoping legs for adjusting a vertical height of the frame structure, each vertical telescoping leg having a multiplicity of equally spaced apart holes located therein;

b. means for retaining said vertical height adjustment of said frame structure;

c. a pair of independently-mounted front and rear wheels each respectively secured to said pairs of vertical front and rear telescoping legs at their lower ends for supporting said frame structure;

d. a sling assembly adapted to support said person using said power walker and having an adjustable belt with a multiplicity of connecting rings;

e. a pair of horizontal and opposite upper side rails functioning as handrails, the upper side rails secured to said pairs of vertical front and rear telescoping legs at their upper ends, each upper side rail having an elongated narrow slit groove, each groove facing the other, and a locking hook mounted to each one of the upper side rails and located adjacent to said rear end of said frame structure;

f. a hydraulic piston fluid cylinder respectively mounted within each one of said pair of horizontal and opposite upper side rails and having a first end with a locking hook and a second end;

g. a hydraulic pump assembly mounted on said frame structure for supplying hydraulic pressure to said hydraulic piston fluid cylinders;

h. a drive motor mounted on said frame structure for driving said hydraulic pump assembly;

i. control means mounted on each one of said pair of horizontal and opposite upper side rails for controlling the extension or retraction of said first ends of said hydraulic piston fluid cylinders;

j. at least two cables, each cable having a first end and a second end, where a respective one of the at least two cables is hooked through a respective set of said locking hooks at said first end of said respective hydraulic piston fluid cylinder and said respective upper side rail, and the first and second ends of the at least two cables having locking hooks for attaching to selective ones of said multiplicity of connecting rings of said adjustable belt of said sling assembly respectively in order to locate the lifting pressure on said person;

k. said locking hook at said first end of said hydraulic piston fluid cylinder is moved in a horizontal direction to thereby raise or lower a selective location on said sling assembly for the purpose of adjusting the amount of weight on each leg of said person;

l. steering means for steering said power walker;

m. means for driving each one of said front wheels;

n. power control switch means for powering and steering said power walker; and o. at least one electric storage battery electrically connected to said means for driving each one of said front wheels of said power walker;

p. whereby when said person is properly connected to said power walker, the amount of weight by which said person is supported by each leg independently can be properly adjusted by connecting said locking hooks at said first and second ends of said at least two cables to said connecting rings and extending or retracting said locking hooks at said first ends of said hydraulic piston fluid cylinders respectively.

5. The power walker as defined in claim 4 further comprising a hydraulic pump mounted on said frame structure for manually supplying hydraulic pressure to said hydraulic piston fluid cylinders.

6. The power walker as defined in claim 4 wherein said frame structure is made out of metal tubing.

7. The power walker as defined in claim 4 wherein said means for retaining said vertical height adjustment of said frame structure includes four metal pins each inserted into a selective one of said multiplicity of holes at said pairs of vertical front and rear telescoping legs respectively.

8. A power walker for use by a person with leg problems, comprising:

a. a rectangular frame structure extending around a front end, a rear end and two opposite sides of an area occupied by said person using said power walker, the frame structure having a pair of vertical front telescoping legs and a pair of rear telescoping legs for adjusting a vertical height of the frame structure, each vertical telescoping leg having a multiplicity of equally spaced apart holes located therein;

b. means for retaining said vertical height adjustment of said frame structure;

c. a pair of independently-mounted front and rear wheels each respectively secured to said pairs of vertical front and rear telescoping legs at their lower ends for supporting said frame structure;

d. a sling assembly adapted to support said person using said walker and having an adjustable belt with a multiplicity of connecting rings;

e. a pair of horizontal and opposite upper side rails functioning as handrails, the upper side rails secured to said pairs of vertical front and rear telescoping legs at their upper ends, each upper side rail having an elongated narrow slit groove, each groove facing the other, and a locking hook mounted to each one of the upper side rails and located adjacent to said rear end of said frame structure;

f. a threaded driving rod respectively mounted within each one of said pair of horizontal and opposite upper side rails and having first ends and second ends;

g. a screw collar screwed onto each one of said threaded driving rods and having a locking hook protruding outwardly from said elongated narrow slit grooves respectively;

h. means for turning said threaded driving rods respectively such that said screw collars are moved in a horizontal direction;

i. at least two cables, each cable having a first end and a second end, where a respective one of the at least two cables is hooked through a respective set of said locking hooks at said respective screw collar and said respective upper side rail, and the first and second ends of the at least two cables having locking hooks for attaching to selective ones of said multiplicity of connecting rings of said adjustable belt of said sling assembly respectively in order to locate the lifting pressure on said person;

j. said screw collar is moved in said horizontal direction by rotating said threaded driving rod to thereby raise or lower a selective location on said sling assembly for the purpose of adjusting the amount of weight on each leg of said person;

k. steering means for steering said power walker;

l. means for driving each one of said front wheels;

m. power control switch means for powering and steering said power walker; and n. at least one electric storage battery electrically connected to said means for driving each one of said front wheels of said power walker;

o. whereby when said person is properly connected to said power walker, the amount of weight by which said person is supported by each leg independently can be properly adjusted by connecting said locking hooks at said first and second ends of said at least two cables to said connecting rings and extending or retracting said screw collars on said threaded driving rods respectively.

9. The power walker as defined in claim 8 wherein said means for turning said threaded driving rods respectively such that said screw collars are moving in said horizontal direction includes a pair of cranks attached to said first ends of said threaded driving rods respectively.

10. The power walker as defined in claim 8 wherein said frame structure is made out of metal tubing.

11. The power walker as defined in claim 8 wherein said means for retaining said vertical height adjustment of said frame structure includes four metal pins each inserted into a selective one of said multiplicity of holes at said pairs of vertical front and rear telescoping legs respectively.

12. A walker for use by a person with leg problems, comprising:

a. a frame structure having a pair of front legs and a pair of rear legs;

b. a pair of front wheels and a pair of rear wheels each respectively secured to said pairs of front and rear legs at their lower ends for supporting said frame structure;

c. said frame structure having a pair of opposite handrails each having a narrow slit and a hook means mounted opposite to the narrow slit;

d. means for supporting said person within said frame structure;

e. a jackscrew mechanism respectively mounted within each one of said pair of opposite handrails and having a collar thereon with a second hook means attached to the collar and a reversible drive motor for turning the jackscrew mechanism;

f. at least two cables, each cable having a first end and a second end, where a respective one of the at least two cables extends through a respective set of said hook means at said respective collar and each one of said pair of opposite handrails, where the first and second ends of the at least two cables are attached to selective ones of said means for supporting said person within said frame structure in order to locate the lifting pressure on said person; and g. said jackscrew mechanism is rotated to cause said collar to move in a horizontal direction to thereby raise or lower a selective location on said means for supporting said person within said frame structure for the purpose of adjusting the amount of weight on each leg of said person;

h. whereby when said person is properly connected to said walker, the amount of weight by which said person is supported by each leg independently can be properly adjusted by extending or retracting said collars on said jackscrew mechanisms.

13. The walker as defined in claim 12 further comprising means for adjusting the height of said pairs of front and rear legs of said frame structure.

14. The walker as defined in claim 13 wherein said means for adjusting the height of said pairs of front and rear legs of said frame structure includes four metal pins each inserted into a selective one of a multiplicity of holes at said pairs of front and rear legs respectively.

15. The walker as defined in claim 12 further comprising control means mounted on each one of said pair of handrails and located adjacent to said pair of front legs of said frame structure for controlling the extension and the retraction of said collars of said jackscrew mechanisms.

16. The walker as defined in claim 12 wherein said frame structure is made out of metal tubing.

17. The walker as defined in claim 12 wherein said means for supporting said person within said frame structure includes a sling assembly having an adjustable belt with a multiplicity of connecting rings.

18. A walker for use by a person with leg problems, comprising:

a. a frame structure having a pair of front legs and a pair of rear legs;

b. a pair of front wheels and a pair of rear wheels each respectively secured to said pairs of front and rear legs at their lower ends for supporting said frame structure;

c. said frame structure having a pair of opposite handrails each having a narrow slit and a hook means located opposite to the narrow slit;

d. means for supporting said person within said frame structure;

e. a hydraulic piston fluid cylinder respectively mounted within each one of said pair of opposite handrails and having a second hook means extending out through said narrow slits respectively;

f. at least two cables, each cable having a first end and a second end, where a respective one of the at least two cables extends through a respective set of said hook means at said respective hydraulic piston fluid cylinder and each one of said pair of opposite handrails, where the first and second ends of the at least two cables are attached to selective ones of said means for supporting said person within said frame structure in order to locate the lifting pressure on said person; and g. said hook means of said hydraulic piston fluid cylinder is extended or retracted in a horizontal direction to thereby raise or lower a selective location on said means for supporting said person within said frame structure for the purpose of adjusting the amount of weight on each leg of said person;

h. whereby when said person is properly connected to said walker, the amount of weight by which said person is supported by each leg independently can be properly adjusted by extending or retracting said hook means of said hydraulic piston fluid cylinders.

19. The walker as defined in claim 18 further comprising a hydraulic pump assembly for supplying hydraulic pressure to said hydraulic piston fluid cylinders.

20. The walker as defined in claim 19 further comprising a drive motor for driving said hydraulic pump assembly.

21. The walker as defined in claim 18 further comprising control means for controlling the extension and the retraction of said hook means of said hydraulic piston fluid cylinders.

22. The walker as defined in claim 18 further comprising means for driving said walker.

23. The walker as defined in claim 22 wherein means for driving said walker is motorized.

24. The walker as defined in claim 22 wherein means for driving said walker is manual.

25. A walker for use by a person with leg problems, comprising:

a. a frame structure having a pair of front legs and a pair of rear legs;

b. a pair of front wheels and a pair of rear wheels each respectively secured to said pairs of front and rear legs at their lower ends for supporting said frame structure;

c. said frame structure having a pair of opposite handrails each having a narrow slit and a hook means mounted opposite to the narrow slit;

d. means for supporting said person within said frame structure;

e. a threaded driving rod respectively mounted within each one of said pair of opposite handrails;

f. a screw collar screwed onto each one of said threaded driving rods and having hook means protruding outwardly from each one of said narrow slits;

g. at least two cables, each cable having a first end and a second end, where a respective one of the at least two cables extends through a respective set of said hook means at said respective screw collar and each one of said pair of opposite handrails, where the first and second ends of the at least two cables are attached to selective ones of said means for supporting said person within said frame structure in order to locate the lifting pressure on said person; and h. said screw collar is extended or retracted in a horizontal direction by rotating said threaded driving rod to thereby raise or lower a selective location on said means for supporting said person within said frame structure for the purpose of adjusting the amount of weight on each leg of said person;

i. whereby when said person is properly connected to said walker, the amount of weight by which said person is supported by each leg independently can be properly adjusted by extending or retracting each one of said screw collars and the location of the supporting pressure can be adjusted by properly locating the areas of attachment of the first and second ends of said at least two cables to said means for supporting said person.

26. The walker as defined in claim 25 further comprising a pair of cranks respectively attached to said first ends of said threaded driving rods for extending or retracting said screw collars.

27. The walker as defined in claim 25 further comprising means for driving said walker.

28. The walker as defined in claim 27 wherein means for driving said walker is motorized.

29. The walker as defined in claim 27 wherein means for driving said walker is manual.

* * * * *